US006620775B2

(12) United States Patent
Winston et al.

(10) Patent No.: US 6,620,775 B2
(45) Date of Patent: Sep. 16, 2003

(54) VISCOSITY STABILIZATION IN ALKALINE SOLUTIONS

(75) Inventors: Philip E. Winston, San Diego, CA (US); John M. Swazey, San Diego, CA (US)

(73) Assignee: CP Kelco U.S. Inc., Wilmington, DE (US)

( * ) Notice: Subject to any disclaimer, the term of this patent is extended or adjusted under 35 U.S.C. 154(b) by 54 days.

(21) Appl. No.: 09/992,563

(22) Filed: Nov. 26, 2001

(65) Prior Publication Data

US 2003/0100460 A1 May 29, 2003

(51) Int. Cl.[7] ..... C11D 3/38; C11D 17/00; C11D 7/02

(52) U.S. Cl. ..... 510/470; 510/435; 510/471; 510/513

(58) Field of Search ..... 510/405, 470, 510/471, 499, 513, 461, 435

(56) References Cited

U.S. PATENT DOCUMENTS 5,175,278 A 12/1992 Peik et al.

6,110,271 A * 8/2000 Skaggs et al. ..... 106/804

FOREIGN PATENT DOCUMENTS

| | | |
|---|---|---|
| DE | 2841383 | 4/1980 |
| WO | WO 9722564 | 6/1997 |
| WO | WO 0036078 | 6/2000 |
| WO | WO 0164897 | 9/2001 |
| WO | WO 02055641 | 7/2002 |

OTHER PUBLICATIONS

Moorhouse, P., Industrial Polysaccharides: Yalpani, M., Ed.; Elsevier, Amsterdam, 1987; vol. 3, pp. 187–206.*

S. Diltz, S. G. Zeller/ "Location of O–acetyl groups in S–657 using the reductive–cleavage method" Carbohydrate Research 331 (2001), pp. 265–270.

International Search Report of PCT/US02/33637 dated Mar. 3, 2003.

* cited by examiner

*Primary Examiner*—Yogendra N. Gupta
*Assistant Examiner*—John M. Petruncio
(74) *Attorney, Agent, or Firm*—Banner & Witcoff, Ltd.

(57) ABSTRACT

An aqueous alkaline solution comprising at least a caustic and a viscosity stabilizing amount of diutan gum.

20 Claims, No Drawings

VISCOSITY STABILIZATION IN ALKALINE SOLUTIONS

FIELD OF THE INVENTION

The invention relates to stabilizing the viscosity of alkaline solutions.

BACKGROUND OF THE INVENTION

Polymeric viscosity stabilizers such as cellulosics, alginates, and biogums, are used in compositions as thickening agents. However, such polymneric viscosity stabilizers generally do not have long-term stability in highly alkaline aqueous systems such as in household cleaners. Such cleaners often contain from about 0.5 to about 15 wt % caustic materials, such as sodium hydroxide, and have a pH of at least 10, typically about 12 to about 14. In order to have a suitable shelf life, such cleaners require long-term viscosity stability, e.g. for more than 12 months.

If the solution is unstable, either gelation or complete loss of viscosity occurs. Currently, xanthan gum is often used in these systems because it has relatively good stability under alkaline conditions. However, xanthan gum can exhibit gelation at higher levels of caustic and will show significant degradation over time, especially at elevated temperatures. Therefore, it is desired to have a thickener that provides even higher stability than xanthan gum.

BRIEF SUMMARY OF THE INVENTION

The present invention is directed to an aqueous alkaline solution comprising at least a caustic and a viscosity-stabilizing amount of diutan gum. Typical caustics used in cleaning solutions include sodium hydroxide, potassium hydroxide, ammonium hydroxide, sodium carbonate, or sodium silicate. Typically, the aqueous alkaline composition has a caustic concentration from about 0.5 wt % to about 15 wt %, based on the total weight of the solution, to achieve a pH of at least 10. The amount of the diutan gum is preferably from about 0.05 wt % to about 2 wt %, based on the total weight of the solution.

In further embodiments, the aqueous alkaline composition contains at least one of a sequesterant, surfactant, or organic solvent.

Another embodiment of the invention is directed to a method of increasing the stability of an aqueous alkaline composition comprising adding to the aqueous alkaline composition a viscosity stabilizing amount of diutan gum.

DETAILED DESCRIPTION OF THE INVENTION

Diutan gum is heteropolysaccharide S-657, which is prepared by fermentation of a strain of Sphingomonas sp. ATCC 53159. It has thickening, suspending, and stabilizing properties in aqueous solutions. Heteropolysaccharide S-657 is composed principally of carbohydrate, about 12% protein and about 7% (calculated as O-acetyl) acyl groups, the carbohydrate portion containing about 19% glucuronic acid, and the neutral sugars rhamnose and glucose in the approximate molar ratio of 3:2. Details of the diutan gum structure may be found in an article by Diltz et al., "Location of O-acetyl groups in S-657 using the reductive-cleavage method" *Carbohydrate Research* 331 (2001) 265–270, which is hereby incorporated by reference in its entirety. Details of preparing diutan gum may be found in U.S. Pat. No. 5,175,278, which is hereby incorporated by reference in its entirety.

It was discovered that aqueous alkaline solutions containing diutan gum have superior stability when compared to aqueous alkaline solutions containing xanthan gum at different concentrations of the gums. It was further discovered that diutan gum can be used as a thickening agent in aqueous alkaline solutions used to prepare household and industrial cleaners.

Aqueous alkaline solutions useful for household and industrial cleaners have a pH of at least 10, typically from about 12 to about 14. The aqueous alkaline solutions typically contain at least one caustic agent such as sodium hydroxide, potassium hydroxide, sodium silicate, ammonium hydroxide, sodium carbonate, or mixtures thereof. Generally about 0.5 wt % to about 15 wt % of the caustic is present in the alkaline solution, preferably about 5 wt % to about 12 wt %, more preferably about 10 wt %, based on the total weight of the solution.

Diutan gum is added in an amount effective to thicken and stabilize the aqueous alkaline solution. Effective amounts include from about 0.05 wt % to about 2 wt %, preferably about 0.1 wt % to about 1 wt %, more preferably about 0.2 wt % to about 0.8 wt %, based on total weight of the solution.

The aqueous alkaline solutions further contain other ingredients useful in cleaners. Such solutions may contain effective amounts of surfactants used as foaming wetting agents, and detergents. Organic solvents such as glycols and glycol ethers such as polyethylene glycol (PEG) or butyl cellusolve may also be present to aid in the removal of organic deposits, stains or coatings. Sequesterants are also added as builders to boost the effect of the detergent and to solubilize polyvalents salts. Sequesterants such as sodium glucoheptonate are also helpful at controlling polyvalents like iron that, if unsequestered, may catalyze base hydrolysis of the biogum thickener and lead to viscosity loss. Sequesterants also help to prevent polyvalent induced gelation.

EXAMPLE 1

The stability of diutan gum and xanthan gum in aqueous alkaline solutions were compared at different temperatures. The alkaline stability of the biogums was evaluated at both ambient and elevated temperatures. A 2% (by weight of water) stock solution in standard tap water was made for each gum using polyethylene. glycol (PEG) as a dispersant. Two percent sodium glucoheptonate was added as a sequestrant to each alkaline solution. The gum stock was diluted to the desired concentration and mixed with the appropriate amount of 50% caustic until the solution looked completely hydrated and appeared to be homogenous.

The trials were formulated for 200 ml lots. The lots were split into two 100 ml lots: one was stored at 120° F. (48.9° C.) and the other at room temperature. Viscosity measurements and visual observations were taken initially when solutions were prepared, at 1 day, 7 days, 28 days, 60 days, and 90 days.

1. Storage at 25 ° C. for 90 days. Change in Brookfield viscosity at 30 RPM:

| Biogum: | Gain (+) or Loss (−) of Initial Viscosity |
|---|---|
| 0.25% diutan gum in 10% NaOH | −3% |

-continued

| Biogum: | Gain (+) or Loss (−) of Initial Viscosity |
|---|---|
| 0.25% xanthan gum (Kelzan ®T) in 10% NaOH | −70% |

2. Storage at 25 ° C. for 90 days. Change in Brookfield viscosity at 3 RPM:

| Biogum: | Gain (+) or Loss (−) of Initial Viscosity |
|---|---|
| 0.25% diutan gum in 10% NaOH | −20% |
| 0.25% xanthan gum (Kelzan T) in 10% NaOH | Viscosity too low to measure |
| 0.50% diutan gum in 10% NaOH | +2% |
| 0.50% xanthan gum (Kelzan T) in 10% NaOH | −96% |

3. Storage at 120° F. for 28 days. Change in Brookfield viscosity at 60 RPM:

| Biogum: | Gain (+) or Loss (−) of Initial Viscosity |
|---|---|
| 0.50% diutan gum in 10% NaOH | −4% |
| 0.50% xanthan gum (Kelzan T) in 10% NaOH | −85% |

The samples stored at room temperature had better stability than the samples that were stored at 120° F. The temperature speeds up the deterioration of the gum in very caustic environments. Samples that maintained viscosity after 28 days at elevated temperatures were considered to be "good" performers. At elevated temperature, the 0.50% diutan gum had better performance than the 0.50% xanthan gum. The higher concentration of diutan gum also performed better than the 0.25% diutan gum.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

We Claim:

1. An aqueous alkaline solution comprising at least a caustic and a viscosity stabilizing amount of diutan gum.

2. The aqueous alkaline solution of claim 1 wherein the pH is at least 10.

3. The aqueous alkaline solution of claim 1 wherein the pH is from about 12 to about 14.

4. The aqueous alkaline composition of claim 1 wherein the caustic is sodium hydroxide, potassium hydroxide, sodium silicate, ammonium hydroxide, sodium carbonate, or mixtures thereof.

5. The aqueous alkaline composition of claim 1 where the concentration of the caustic is from about 0.5 wt % to about 15 wt %, based on the total weight of the solution.

6. The aqueous alkaline composition of claim 5 wherein the concentration of the caustic is from 5 wt % to about 12 wt %, based on the total weight of the solution.

7. The aqueous alkaline composition of claim 1 further comprising at least one of a sequesterant, surfactant, or organic solvent.

8. The aqueous alkaline composition of claim 1 wherein the amount of the diutan gum is from about 0.05 wt % to about 2 wt %, based on the total weight of the solution.

9. The aqueous alkaline composition of claim 8 wherein the concentration of the diutan gum is from about 0.1 wt % to about 1 wt %, based on the total weight of the solution.

10. The aqueous alkaline composition of claim 9 wherein the concentration of the diutan gum is from about 0.2 wt % to about 0.8 wt %, based on the total weight of the solution.

11. An aqueous alkaline solution comprising from about 0.5 wt % to about 15 wt % based on the total weight of the solution of a caustic, and from about 0.05 wt % to about 2 wt %, based on the total weight of the solution, of diutan gum.

12. The aqueous alkaline solution of claim 11 wherein the pH is at least 10.

13. The aqueous alkaline solution of claim 12 wherein the pH is from about 12 to about 14.

14. The aqueous alkaline composition of claim 11 wherein the caustic is sodium hydroxide.

15. The aqueous alkaline composition of claim 11 wherein the concentration of the caustic is from 5 wt % to about 12 wt %, based on the total weight of the solution.

16. The aqueous alkaline composition of claim 11 further comprising at least one of a sequesterant, surfactant, or organic solvent.

17. The aqueous alkaline composition of claim 11 wherein the concentration of the diutan gum is from about 0.1 wt % to about 1 wt %, based on the total weight of the solution.

18. The aqueous alkaline composition of claim 17 wherein the concentration of the diutan gum is from about 0.2 wt % to about 0.8 wt %, based on the total weight of the solution.

19. A method of increasing the stability of an aqueous alkaline composition comprising adding to the aqueous alkaline composition a viscosity stabilizing amount of diutan gum.

20. An aqueous alkaline cleaner composition comprising at least a caustic and a viscosity stabilizing amount of diutan gum, and at least one of a sequesterant, surfactant or organic solvent to promote cleaning.

* * * * *